United States Patent [19]

Bell

[11] Patent Number: 4,692,772

[45] Date of Patent: Sep. 8, 1987

[54] ANTENNA EXTENDED SURFACE ATTACHMENT

[76] Inventor: Joseph P. Bell, #40 Cedar Village, Punta Gorda, Fla. 33950

[21] Appl. No.: 650,069

[22] Filed: Sep. 13, 1984

Related U.S. Application Data

[63] Continuation-in-part of Ser. No. 588,332, Mar. 12, 1984, abandoned.

[51] Int. Cl.[4] ..... H01Q 9/40

[52] U.S. Cl. ..... 343/899; 343/900; 343/749

[58] Field of Search ..... 343/750, 899, 895, 715, 343/749, 900, 908

[56] References Cited

U.S. PATENT DOCUMENTS

| | | | |
|---|---|---|---|
| 2,748,387 | 5/1956 | Klancnik | 343/802 |
| 3,251,063 | 5/1966 | McKee | 343/749 |
| 3,500,423 | 3/1970 | Church | 343/873 |
| 4,038,661 | 7/1977 | Nolte | 343/750 |
| 4,238,801 | 12/1980 | Bell | 343/899 |

*Primary Examiner*—William L. Sikes
*Assistant Examiner*—Michael C. Wimer
*Attorney, Agent, or Firm*—Hill, Van Santen, Steadman & Simpson

[57] ABSTRACT

A supplemental device is provided for mounting on a rod-type antenna for CB radio, cellular telephone, telephone, television and satellite communications for reducing the overall noise level in connection with the operation of, for example, the squelch control structure of the associated radio apparatus. The device comprises a pair of assemblies each having at least one ring and a plurality of cooperable radially-extending rods symmetrically arranged and intersecting the axis of the associated ring or rings, with such rings and rods secured in rigid relation any lying in substantially a common plane. The assemblies are disposed in spaced parallel planes and rigidly connected substantially of their common axis by a cross member which is adapted for adjustable securement to an antenna, whereby the supplemental device may be secured to the antenna at an optimum location therealong, with the antenna extending in a plane parallel to and between the first-mentioned planes. A spring element may be slidably mounted on the antenna rod for further tuning with respect to sensitivity and noise. The rings, rods and spring element are made of a chrome-platable plastic, such as ABS plastic, and are plated with chrome.

14 Claims, 4 Drawing Figures

ANTENNA EXTENDED SURFACE ATTACHMENT

CROSS REFERENCE TO RELATED APPLICATION

This application is a continuation-in-part of my copending application Ser. No. 588,332, filed Mar. 12, 1984, now abandoned.

BACKGROUND OF THE INVENTION

1. Field of the Invention

The present invention relates to a supplemental device that may be employed in connection with antennas, such as C-B antennas, television antennas, radio telephone antennas including cellular radio telephone, and the like for improving the operation with respect to transmission and, in particular, with respect to the noise level during operation, and particularly to such a device which is not susceptible to the environment with respect to rust, corrosion and the like.

2. Description of the Prior Art

Radios of the type involved employ what is is known as a "squelch" control which reduces the sensitivity level below the noise level and therefore renders the radio quiet, i.e. without interference noise, etc. Upon receipt of a signal, above a threshold set by the circuit involved, the gain is increased. While the circuit is adjustable, to determine the desired threshold level, maximum sensitivity can be achieved only with accompanying noise and, depending upon the location, such noise level can be relatively high. However, many users will set a threshold level at the relatively low point to utilize maximum sensitivity with the result that the nose level is very high, while such a setting, at the same time, may not result in a complete quieting or squelch operation.

The invention is directed to a device for effectively reducing such noise level without material reduction, if any, in the sensitivity of the receiver.

The basic geometric structure of the supplemental antenna device is disclosed in my U.S. Letters Pat. No. 4,238,801, issued Dec. 9, 1980, which is fully incorporated herein by this reference.

SUMMARY OF THE INVENTION

The present invention is therefore directed to a weather-resistant device in the form of a supplemental structure which may be mounted on existing antennas, as well as new antennas, and which will provide a reduction in noise level, with no apparent loss in signal strength, and not be subject to rest, corrosion and the like.

The present invention employs a structure, as disclosed in my aforementioned U.S. Pat. No. 4,238,801, which is mounted on an antenna and comprises a pair of assemblies, each having at least one ring member and a plurality of radially-extending cross members. Each assembly has the ringing cross members thereof disposed in substantially a common plane and secured to one another to form a rigid assembly. The two assemblies are disposed in spaced relation, in respective parallel planes, and are rigidly connected to one another by a cross member which also forms a part of the structure for securing the device to an antenna structure. In cross section, each of the rings and cross members, in a first embodiment, comprise an ABS plastic or the like, which is platable with chrome, carrying a chrome outer layer. In a second embodiment, any other dielectric material may be employed and coated with a base layer, such as copper, which, in turn, carries the outer chrome layer.

In use, the device is mounted on an antenna, initially adjusting the same along the length of the antenna, to manually determine the optimum location of the device along the length of the antenna. Once such optimum position is determined, the device may be rigidly secured to the antenna and left in such an adjusted position.

If desired, an additional supplemental member may be employed, which in the embodiments of the invention illustrated, is in the form of a coil spring and, which likewise may be positioned at an optimum point along the length of the antenna in the same manner as set forth above. In some cases such a supplemental structure may be omitted. In any case, the supplemental structure may also be constructed entirely of a metal material, or may be a plastic carrying a chrome layer with or without an intermediate base layer, such as copper.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
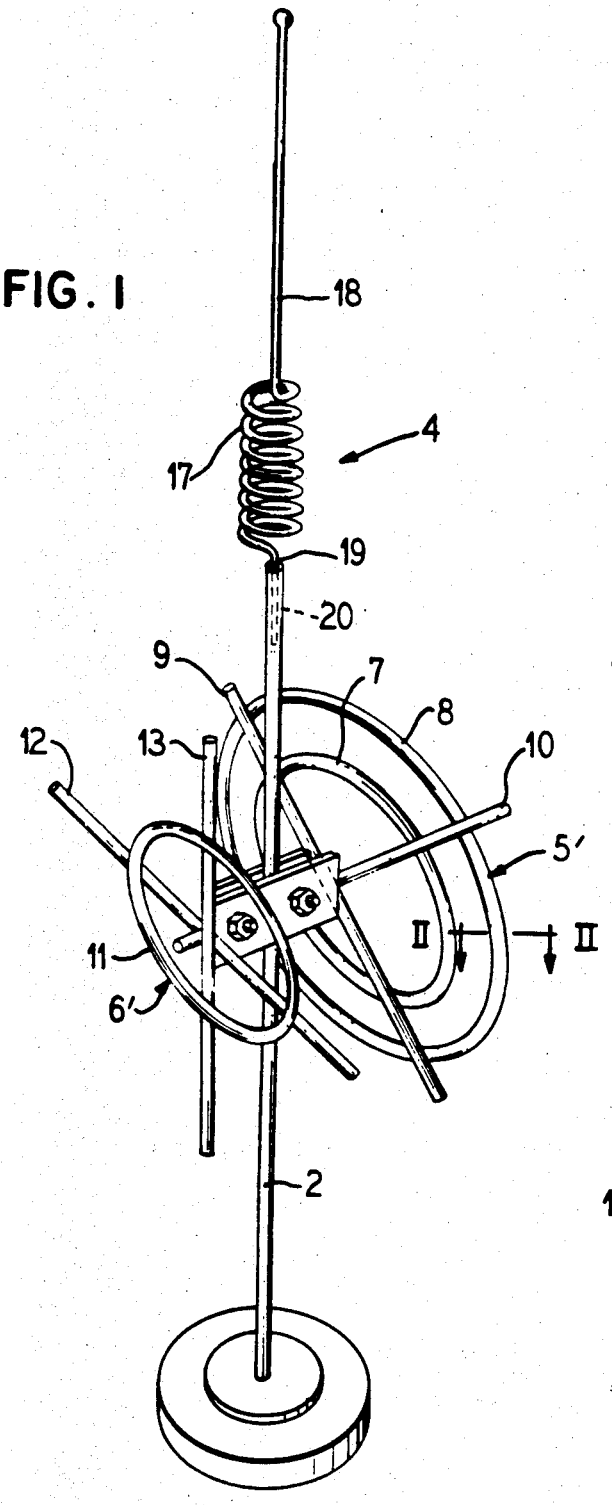
FIG. 1 is a perspective view of an antenna having a supplemental device, constructed in accordance with the present invention, mounted thereon and mounting a first additional supplemental member.

Referring to the drawings, and in particular to FIG. 1, a supplental device constructed in accordance with the invention is referenced 1 and is illustrated as being mounted on a vertically-extending rod or pole-type antenna 2 which is supported from a base structure 3. The base structure 3 may be mounted, for example, on a vehicle in connection with a mobile radio installation.

According to the invention, an additional device may also be mounted on the antenna, the additional device being referenced 4 in FIG. 1.

As is evident, the structural appearance of the supplemental device 1 is exactly as illustrated in my aforementioned U.S. Pat. No. 4,238,801.

As more specifically illustrated in FIG. 1, the device 1 comprises two assemblies generally referenced 5 and 6. The assembly 5 comprises a pair of rings 7 and 8 of different sizes concentrically disposed in a common plane. The rings 7 and 8 are connected by respective rods 9 and 10 which, as illustrated, are disposed at right angles to one another and intersect on the axis of the concentric rings and thus form four radially-extending elements. As illustrated, the rods 9 and 10 have a length somewhat greater than the diameter of the larger ring 8. The rings and rods are rigidly secured to one another at their intersecting points by a suitable bonding process.

The assembly 6 is similarly constructed and employs a single ring 11 which may have the same diameter as the ring 7. A pair of rods 12 and 13, corresponding to the rods 9 and 10, likewise intersect on the axis of the ring 7, and are secured to the ring by a suitable bonding process, in the same manner as the elements of the assembly 5. As illustrated the rods 12 and 13 of the assembly 6 are of the same length as the rods 9 and 10 of the assembly 5.

As is evident, the rings 7, 8, 11 and rods 9, 10, 12, 13 are electrically connected to one another and to the antenna rod 2.

For the mounting and adjustment of the supplemental device, one may take reference to my aforementioned U.S. Pat. No. 4,238,801.

Figure 2:
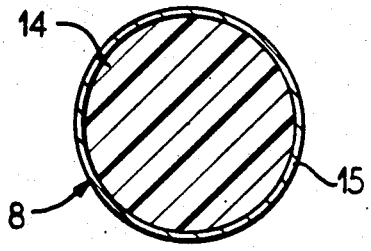
FIG. 2 is a sectional view taken substantially along the line II—II of FIG. 1.
Figure 3:
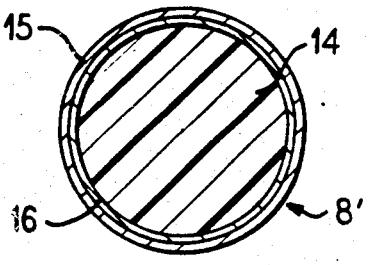
FIG. 3 is a further sectional view of another embodiment of the invention, also taken substantially along the line II—II of FIG. 1.

A supplemental device constructed in accordance with the present invention is illustrated in a first embodiment in FIG. 2 and in a second embodiment in FIG. 3. The sectional views of FIGS. 2 and 3 have been illustrated as being taken through the ring 8. The same sectional views, would also be evident as taken through the rings 7 and 11 and the rods 9, 10, 12 and 13. Also, the same sectional view may be applied to the spring element 4 and the spring element 4' of FIG. 4 if such element is to also be constructed in accordance with the invention.

Referring to FIG. 2, the ring 8 is illustrated as comprising a core 14 of ABS plastic or other metal-platable material, particularly a chrome-platable material as in ABS plastic.

Referring to FIG. 3, a section through a ring, here referenced 8' is illustrated as comprising a core 14 of plastic material, an outer metal layer 15 of chrome, and an inner metal layer 16 for supporting the outer metal layer 15 on the plastic core 14.

Various processes are available for manufacturing the supplemental antenna device of the present invention. In this connection, reference is taken to the publication "Modern Plastics Encyclopedia, 1983–84, and more particularly to the article therein by Gerald Krulik and John Waggoner, entitled "Electroplating and Sputtering", pp. 358–362.

As mentioned above, the rods are bonded to the rings. This bonding can occur with the formation of each assembly as a unitary element prior to the application of a metallic coating or coatings.

As with the supplemental device disclosed in my aforementioned U.S. Pat. No. 4,238,801, a pair of elements 13,14 may be employed to connect the assemblies and adjustably secure the device to an antenna.

In FIG. 3, the inner metal layer 16 may comprise a plurality of metal layers or a plurality of metals as set forth in the forementioned publication "Modern Plastics Encyclopedia".

Turning now to the additional element 4, which may also have a cross section as set forth in FIGS. 2 and 3, the element is seen as comprising a helical or spring-type section 17 with a pair of straight projecting members 18 and 19 which lie substantially parallel to the longitudinal axis of the spring 17. The projection 19 may be inserted in a bore 20 of the rod 2 and, because of the metallic outer layer 15 the element 4 is electrically connected to the rod 2. A metal spring structure, however, as set forth in my aforementioned patent, may also be employed for the element 4.

Figure 4:
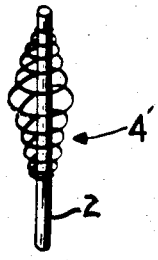
FIG. 4 is a view of the top end of the antenna shown mounting a second additional supplemental member.

Referring to FIG. 4, the spring element 4' is shown mounted on the antenna rod 2. The element 4' may be a metal spring with at least one conical taper, preferably two conical tapers as set forth in my aforementioned U.S. Pat. No. 4,238,801. It may also be a metallically-clad structure as set forth above having a cross-section of the type shown in FIG. 3. In either case, the element 4', in the manner of the element 4 herein or in my aforementioned U.S. Pat. No. 4,238,801, is slidably mounted with respect to the antenna rod 2 to optimize sensitivity and minimize noise.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. In a supplemental device for mounting on a rod-type antenna of the type in which a pair of assemblies each comprise at least one conductive ring member and a plurality of cooperable conductive rod members connected to said at least one ring member symmetrically arranged and physically intersecting each other and the axis of said at least one ring, said at least one ring and the rod members of each assembly connected together and lying in substantially a common plane with the assemblies spaced and connected together substantially coaxially in parallel planes via a cross member which is adapted for mechanical and electrical connection to the antenna such that the antenna is substantially centered between the aforementioned planes, the improvement wherein:

each of said rings comprises a core of plastic material and an outer layer of metal;

the rod-type antenna comprises a first member including a bore, and a second member; and a metal clad structure constituting said second member and including a winding and first and second projections extending substantially parallel to the axis of the winding, one of said projections received in and making electrical contact with the bore of the first member.

2. The improved device of claim 1, wherein:

one of said assemblies comprises a pair of said rings fixed coaxially with respect to one another.

3. The improved device of claim 1, wherein:

said core comprises a chrome-platable plastic.

4. The improved device of claim 1, wherein:

said core comprises an ABS plastic.

5. The improved device of claim 1, wherein:

said outer layer comprises chrome.

6. The improved device of claim 1, wherein:

said rod members each comprise a core of plastic material and an outer layer of metal.

7. The improved device of claim 5, wherein:

said core of each rod member comprises a chrome-platable plastic.

8. The improved device of claim 6, wherein:

said core of each rod member comprises an ABS plastic.

9. The improved device of claim 6, wherein:

said outer metal layer on each rod member comprises chrome.

10. The improved device of claim 1, wherein:

each of said rings and each of said rod members comprises a plastic core, a metal base layer covering said core, and a chrome layer covering said metal base layer.

11. In a supplemental device for mounting on a rod-type antenna of the type in which a pair of assemblies each comprise at least one conductive ring member and a plurality of cooperable conductive rod members connected to said at least one ring member symmetrically arranged and physically intersecting each other and the axis of said at least one ring member, said at least one ring member and the rod members of each assembly connected together and lying in substantially a common plane with the assemblies spaced and connected together substantially coaxially in parallel planes via a cross member which is adapted for mechanical and electical connection to the antenna such that the antenna is substantially centered between the aformentioned planes, and in which a spring element is carried on the rod type antenna, the improvement wherein:

said spring element comprises a core of plastic material and an outer layer of metal;

the rod-type antenna comprises first and second axial members, said first member including a bore for axially receiving said second member; and a metal clad structure constitutes said second member and includes a winding constituting said spring element and first and second projections extending substantially parallel to the axis of the winding, one of said projections received in and making electrical contact with the bore of said first rod member.

12. The improved device of claim 11, wherein:

said core comprises an ABS plastic; and said metal comprises chrome.

13. The improved device of claim 11, wherein:

said spring element comprises at least one conical section for gripping the rod of the antenna.

14. In a supplemental device for mounting on a rod-type antenna of the type in which a pair of assemblies each comprise at least one conductive ring member and a plurality of cooperable conductive rod members connected to said at least one ring member symmetrically arranged and physically intersecting each other and the axis of said at least one ring member, said at least one ring member and the rod members of each assembly connected together and lying in substantially a common plane with the assemblies spaced and connected together substantially coaxially in parallel planes via a cross member which is adapted for mechanical and electrical connection to the antenna such that the antenna is substantially centered between the aforementioned planes, and in which a spring element is slidably mounted on the rod of the antenna, the improvement wherein:

said spring element comprises a core of plastic material and an outer layer of metal;

the rod-type antenna comprises a bore in its distal end; and said spring element comprises a helical section and an elongate section frictionally and slidably received in the bore of the rod-type antenna.

* * * * *